US006448148B2

(12) United States Patent
Yoshimura et al.

(10) Patent No.: US 6,448,148 B2
(45) Date of Patent: Sep. 10, 2002

(54) METHOD FOR FORMING A THIN FILM

(75) Inventors: Masahiro Yoshimura; Takeshi Fujiwara, both of Kanagawa Pref.; Tomoaki Watanabe, Tokyo; Ryo Teranishi, Kanagawa Pref., all of (JP)

(73) Assignee: Tokyo Institute of Technology, Toky (JP)

( * ) Notice: Subject to any disclaimer, the term of this patent is extended or adjusted under 35 U.S.C. 154(b) by 0 days.

(21) Appl. No.: 09/810,748

(22) Filed: Mar. 16, 2001

(30) Foreign Application Priority Data

Mar. 17, 2000 (JP) ..... 2000-076124
Feb. 14, 2001 (JP) ..... 2001-036319

(51) Int. Cl.[7] ..... H01L 21/76
(52) U.S. Cl. ..... 438/409; 438/960
(58) Field of Search ..... 438/409, 479, 438/492, 497, 704, 903, 905, 960

(56) References Cited

U.S. PATENT DOCUMENTS 3,361,591 A * 1/1968 Hans et al. ..... 117/201
3,472,679 A * 10/1969 Samuel et al. ..... 117/93
3,761,308 A 9/1973 Galli

FOREIGN PATENT DOCUMENTS

EP 0 061 176 A1 9/1982
JP 01 079007 A 3/1989

OTHER PUBLICATIONS

J. Kuczynski and J.K. Thomas, Photophysical Properties of Cadmium Sulfide Deposited in Porous Vycor Glass, Journal of Physical Chemistry vol. 89 No. 10—May 9, 1985, pp2720–2722.

* cited by examiner

*Primary Examiner*—David Nelms
*Assistant Examiner*—David Nhu
(74) *Attorney, Agent, or Firm*—Knobbe, Martens, Olson & Bear, LLP

(57) ABSTRACT

A water solution of lead nitrate is infiltrated into a substrate made of a porous material, and liquid drops of a water solution of sodium sulfide, which is charged into a ink cartridge of a minute nozzle, are sprayed onto the substrate from the minute nozzle. The lead component from the lead nitrate water solution and the sulfur component from the sodium sulfide water solution are synthesized directly on the substrate, and thus, a thin film made of lead sulfide is formed on the substrate.

7 Claims, 1 Drawing Sheet

METHOD FOR FORMING A THIN FILM

BACKGROUND OF THE INVENTION

1. Field of the Invention

This invention relates to a method for forming a thin film, particularly to a method for forming a thin film suitable for optical sensors, emission materials, electronic materials.

2. Background of the Invention

So far, a sol-gel method, a CVD method or a PVD method is employed as a thin film-forming method. These methods require multistage process including a heating process, a high vacuum condition, or a high energy condition accompanied with a substrate-heating process or a plasma-generating process. Therefore, those methods require large scale and complicate apparatus, resulting in large cost and complicate operationality in use.

Moreover, the above high energy condition runs counter to global environmental protection, resource saving and energy saving. Therefore, a new thin film-forming method without the above high energy condition has been desired.

SUMMARY OF THE INVENTION

It is an object of the present invention to provide a new thin film-forming method not including a high energy condition due to firing, heating or plasma generation.

This invention relates to a method for forming a thin film comprising the steps of:

preparing a reactive solution incorporating. the components of the thin film, charging the reactive solution into a minute nozzle, and spraying the liquid drops of the reactive solution from the minute nozzle onto a substrate, and thus, synthesizing the components to form the thin film on the substrate.

The inventors related to the present invention have been intensely studied for developing a new thin film-forming method not including a high energy process. As a result, they have found out surprisingly that when a reactive solution incorporating components of a desired thin film is directly sprayed on a substrate from a minute nozzle, the desired compound thin film including the components is synthesized directly on the substrate at room temperature. Then, it has been turned out that the compound thin film has well crystallinity.

Compound particles are synthesized in the substrate through reaction, precipitation and/or drying of the solution in a small amount sprayed on the substrate and they stick to the substrate without any particular pastes or post treatments like firings.

In this regard, the solvent is not restricted but aqueous solvents including organic solvents are preferable because they are vaporable easily.

Since the minute nozzle may be attached to an ink-jet printer, it can be moved relatively for the substrate on which the compound thin film is formed. As a result, the reactive solution can be sprayed on any part of the substrate, and thus, the compound thin film can be easily formed in a linear shape, a dot-shape, a plane-shape or a three dimensional shape.

In a preferred embodiment of the present invention, the substrate is composed of a porous material such as a paper (a filter paper, a glossy paper or a fine paper) or a cloth (a cotton cloth or a polyester cloth), and then, at least one blended solution to constitute the reactive solution is infiltrated into the substrate. Thereafter, the other blended solutions are sprayed onto the substrate from the minute nozzle. As a result, the infiltrated blended solution is reacted with the sprayed blended solution, and thus, the compound thin film, which is composed of the components of the above blended solutions, is synthesized directly on the substrate.

If at least one blended solution to constitute the reactive solution is infiltrated into the porous substrate in advance, the number of the blended solutions to be sprayed from the minute nozzle can be reduced. Therefore, in the synthesis of the above compound thin film on the substrate, the pattern controlling can be easily performed and thus, the compound thin film can be easily formed in various shapes such as linear shape, dot shape, plane shape or three-dimensional shape. Moreover, the adhesion strength between the compound thin film and the substrate can be enhanced by the indefinite anchor effect.

BRIEF DESCRIPTION OF THE DRAWINGS

The invention will be more particularly described with reference to the accompanying drawings.

DESCRIPTION OF THE PREFERRED EMBODIMENTS

Figure 1:
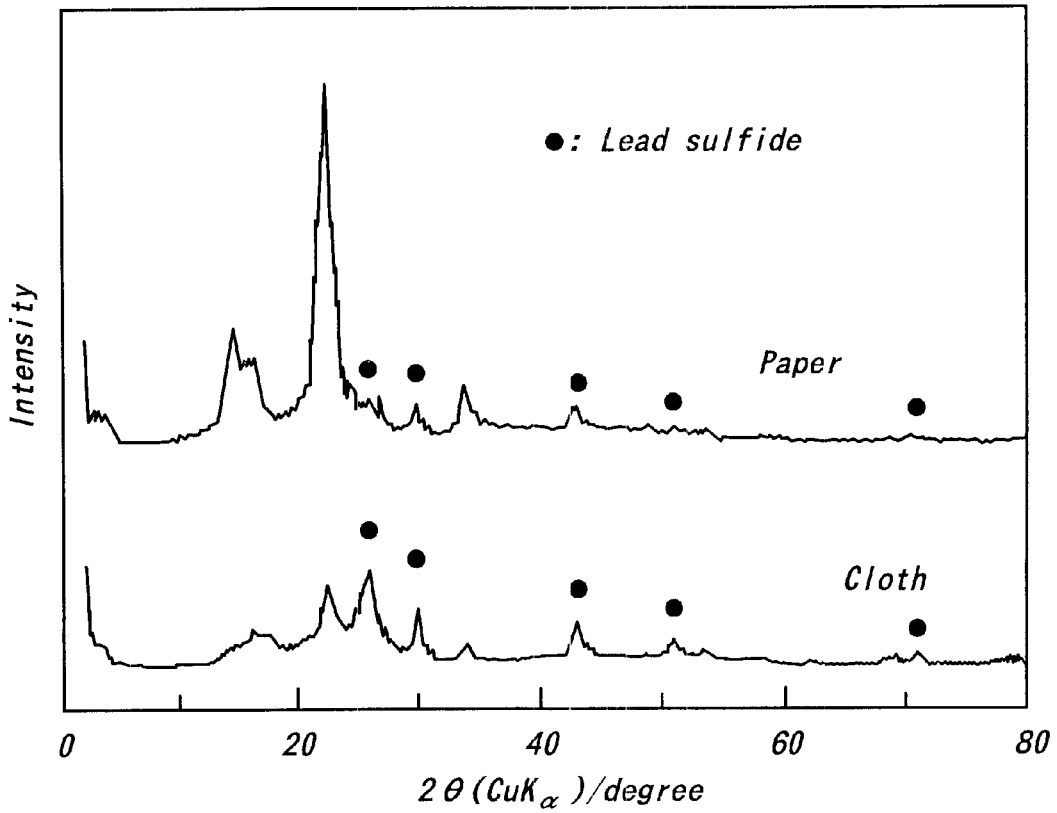
FIG. 1 is a graph showing X-ray diffraction spectra of lead sulfide thin films synthesized by the thin film-forming method of the present invention.

The invention will be described in detail as follows.

The minute nozzle may be composed of commercially available one such as a spray nozzle, an ink jet printer nozzle, a microinjector and a micro-syringe. Then, it is desired that the aperture of the minute nozzle is set within 1 $\mu$m–1000 $\mu$m, particularly 10 $\mu$m–100 $\mu$m, and the length of the minute nozzle is set within 0.1 mm–100 mm, particularly 1 mm–10 mm.

The spraying speed of the reactive solution from the minute nozzle is restricted, depending on the kinds of the substrate and the compound thin film and the kind of the thin film pattern. Preferably, the spraying speed is set within 0.001–100 mL/minute.

There is no limit to the substrate, which may be made of a semiconductor material, a ceramic material, a polymer or the like. Moreover, as mentioned above, if the substrate is made of a porous material such as a paper or a cloth, the compound thin film may be easily formed in various patterns.

According to the present invention, the compound thin film can have some crystal parts through its synthesis without the substrate heating process, but the heating process for the substrate or the like is not always excluded from the present invention. For example, to enhance the forming speed or the properties of the compound thin film, the heating process of 40–150° C. may be included. However, the heating process is performed in a low temperature range, compared with a temperature range (normally, 400–800° C.) in a substrate heating process in the CVD method or the PVD method. Therefore, the film-forming method of the present invention can satisfy no limitation of substrate and the resource saving and energy saving without the high energy process.

The reactive solution may be composed of one or two or more blended solutions, depending on the kind of the compound thin film to be produced.

In using two or more blended solutions, if at least one of the blended solutions is filtrated into the porous substrate, as mentioned above, the compound thin film is easily formed in various patterns. Compound particles are synthesized on the substrate through reaction, precipitation and/or drying of the solution and thus, the adhesion strength between the compound thin film and the substrate is developed.

The concentration of each blended solution depends on the kind of the compound thin film to be produced and the thin film-forming speed, etc.

According to the thin film-forming method of the present invention, various thin films such as a lead sulfide film, a cadmium sulfide film, a titanium oxide film or a ferrite film can be made.

EXAMPLES

This invention will be concretely described with reference to the following examples.

Example 1

A water solution of 0.5 mol % lead nitrate (($Pb(NO_3)_2$, made by Kanto Chemical Corporation) was filtrated into substrates made of a filter paper and a cloth (made by 65% of cotton and 35% of polyester). Then, a water solution of 0.5 mol % sodium sulfide ($NaS.9H_2O$, made by Wako Chemical Corporation) was charged into a minute nozzle composed of a spray nozzle and sprayed onto the substrate for five minutes at a spraying speed of 0.01 mL/minute under room temperature.

Then, the substrates were wet-cleaned, and dried under room temperature. When the surfaces of the substrates were observed by X-ray diffraction, X-ray diffraction patterns as shown in FIG. 1 were given. In FIG. 1, the upper graph represents the X-ray diffraction pattern of the surface of the paper substrate, and the lower graph represents the X-ray diffraction pattern of the surface of the cloth substrate.

As is apparent from FIG. 1, crystal peaks from lead sulfide crystal are observed on the above surfaces of the respective substrates. That is, it is turned out that in this Example, the crystalline lead sulfide film, which is composed of the lead component of the lead nitrate water solution and the sulphur component of the sodium sulfide water solution, is formed on the paper substrate and the cloth substrate.

Moreover, it is turned out that the lead sulfide film is not dropped of by water-washing though it does not have binders therein.

Example 2

A water solution of 0.5 mol % cadmium chloride (($CdCl_2 2.5H_2O$, made by Wako Chemical Corporation) was infiltrated into substrates made of a filter paper and a cloth (made by 65% of cotton and 35% of polyester). Then, a water solution of 0.5 mol % sodium sulfide ($NaS.9H_2O$, made by Wako Chemical Corporation) was charged into a minute nozzle composed of a spray nozzle, and sprayed onto the substrate for five minutes at a spraying speed of 0.01 mL/minute under room temperature.

Then, the substrates were wet-cleaned, and dried under room temperature. When the surfaces of the substrates were observed by X-ray diffraction, crystal peaks from lead sulfide crystal are observed on the respective surfaces of the above substrates. That is, it is turned out that in at this Example, the crystalline cadmium sulfide film, which is composed of the cadmium component of the cadmium chloride water solution and the sulphur component of the sodium sulfide water solution, is formed on the paper substrate and the cloth substrate.

Although this invention bas been described in detail with reference to the above examples, this invention is not limited to the above disclosure and every kind of variation and modification may be made without departing from the scope of the present invention.

According to the present invention, a compound thin film can be directly synthesized on a given substrate at room temperature. Therefore, a high energy condition including a high temperature substrate heating process, a plasma generation or the like is not required, different from a conventional CVD method and PVD method. As a result, a new thin film-forming method not including the high energy condition can be provided.

What is claimed is:

1. A method for forming a Din film comprising the steps of:

preparing a reactive solution incorporating components of the thin film, charging the reactive solution into a minute nozzle, and spraying liquid drops of the reactive solution from the minute nozzle onto a substrate, and thus, synthesizing the components to form the thin film on the substrate.

2. A method for forming a thin film as defined in claim 1, wherein the liquid drops of the reactive solution are sprayed onto predetermined positions of the substrate, and thus, die thin film is formed in a given patterned shape.

3. A method for forming a thin film as defined in claim 1 or 2, wherein the reactive solution is composed of two or more blended solution including the respective components of the thin film.

4. A method for forming a thin film comprising the steps of:

preparing a reactive solution composed of one or more blended solutions incorporating respective components of the thin film, infiltrating at least one of the blended solutions into a porous substrate, charging the other blended solutions except the infiltrated blended solution into a minute nozzle, and spraying liquid drops of the other blended solutions from the minute nozzle onto the porous substrate, and thus, synthesizing the components incorporated in the blended solutions to form the thin film on the porous substrate.

5. A method for forming a thin film as defined in claim 4, wherein the liquid drops of the other blended solutions are sprayed onto predetermined positions of the porous substrate, and thus, the thin film is formed in a given patterned shape.

6. A method for forming a thin film as defined in claim 4 or 5, wherein a water solution of lead nitrate is infiltrated in the porous substrate and liquid drops of a water solution of sodium sulfide are sprayed onto the porous substrate, thereby to synthesize the thin film made of lead sulfide directly on the porous substrate.

7. A method for forming a thin film as defined in claim 4 or 5, wherein a water solution of cadmium chloride is infiltrated in the porous substrate and liquid drops of a water solution of sodium sulfide are sprayed onto the porous substrate, thereby to synthesize the thin film made of cadmium sulfide directly on the porous substrate.

* * * * *